US008774703B2

(12) United States Patent
Nakamura

(10) Patent No.: US 8,774,703 B2
(45) Date of Patent: Jul. 8, 2014

(54) METHOD OF RELEASING DETERMINATION OF FULLY LOADED STATE IN A SHEET STACKING APPARATUS

(75) Inventor: Akihiro Nakamura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 380 days.

(21) Appl. No.: 13/006,510

(22) Filed: Jan. 14, 2011

(65) Prior Publication Data

US 2011/0182646 A1 Jul. 28, 2011

(30) Foreign Application Priority Data

Jan. 22, 2010 (JP) ..... 2010-012580

(51) Int. Cl.
*B41J 13/10* (2006.01)

(52) U.S. Cl.
CPC ..... *B41J 13/106* (2013.01)
USPC ..... 399/405; 271/207; 271/213

(58) Field of Classification Search
CPC ..... B41J 13/106; B41J 13/10
USPC ..... 271/405, 207, 213–215; 400/625; 399/405
See application file for complete search history.

(56) References Cited

U.S. PATENT DOCUMENTS

| | | | | |
|---|---|---|---|---|
| 5,139,254 | A | 8/1992 | Yamashita et al. | |
| 6,378,860 | B1 * | 4/2002 | Gutierrez et al. | 271/217 |
| 6,986,511 | B2 * | 1/2006 | Yamada et al. | 271/294 |
| 7,021,620 | B2 * | 4/2006 | Kakigi | 271/65 |
| 8,157,259 | B2 * | 4/2012 | Iizuka | 271/213 |

FOREIGN PATENT DOCUMENTS

| | | | |
|---|---|---|---|
| JP | 2004-175513 | A | 6/2004 |
| JP | 2007-153466 | A | 6/2007 |
| JP | 2009-249080 | A | 10/2009 |

* cited by examiner

*Primary Examiner* — David Banh
(74) *Attorney, Agent, or Firm* — Fitzpatrick, Cella, Harper & Scinto

(57) ABSTRACT

A stacking unit accommodates sheets stacked on it. The stacking unit is capable of moving up and down within an operation range from a predetermined upper limit to a predetermined lower limit. A determination unit releases a determination of the fully loaded state if elapsed time from the time when the determination unit determines that the stacking unit has been fully loaded with sheets to the time when a sheet detection unit again detects an uppermost sheet of the stacked sheets as a result of the stacking unit being lifted up when the sheet detection unit can no longer detect the sheet after detection of the sheet exceeding a first threshold time preset in correspondence with the amount of curl imparted to the sheet.

13 Claims, 5 Drawing Sheets

METHOD OF RELEASING DETERMINATION OF FULLY LOADED STATE IN A SHEET STACKING APPARATUS

BACKGROUND OF THE INVENTION

1. Field of the Invention

The present invention relates to a sheet stacking apparatus that stacks sheets discharged from another apparatus such as an image forming apparatus.

2. Description of the Related Art

Sheet stacking apparatuses that stack a plurality of sheet-like members are used in various fields. In the field of image forming apparatuses, for example, sheet stacking apparatuses called discharge processing apparatuses are used. A discharge processing apparatus includes a plurality of stacking trays, and when one tray is fully loaded with sheets, the conveying path is switched in order to stack sheets on another tray (alternative tray). This is done because a paper jam occurs if the next sheet is discharged to the tray that has already been fully loaded with sheets. Also, in the case of electrophotographic image forming apparatuses (laser beam printers, for example), a sheet on which an image has been formed is heated to fix the image onto the sheet, so the sheet might be curled immediately after being discharged from the apparatus. Accordingly, a situation can occur in which when curl imparted to the sheet loosens after a sensor detects that the tray has been fully loaded with sheets, the detection of the fully loaded state is released, leading to an erroneous detection of the fully loaded state. In order to solve this problem, Japanese Patent Laid-Open No. 2007-153466 proposes lifting up the tray by an amount equal to a certain predetermined thickness when the fully loaded state is detected by a sensor. In other words, the amount of looseness of the curl of the sheet is canceled out by forcibly lifting up the tray, whereby it is possible to maintain the detection of the fully loaded state.

SUMMARY OF THE INVENTION

However, with the invention described in Japanese Patent Laid-Open No. 2007-153466, the fully loaded state is determined when the top surface of the uppermost sheet of a plurality of stacked sheets is detected by a sheet surface sensor. Such a method of detecting the fully loaded state based only on the sheet surface sensor is problematic in terms of detection accuracy. As described above, when a sheet is heated to fix an image onto the sheet in an image forming apparatus, the sheet might curl. Because the amount of curl decreases over time when the sheet cools, the output of the sheet surface sensor that detects the height of the sheet surface of the sheets discharged on the tray also changes over time. Accordingly, with the sheet surface sensor, it is difficult to detect a fully loaded state and release of the fully loaded state in a stable manner, and the process of stopping image formation and the process of restarting image formation tend to become unstable. In other words, image formation might be restarted when it has to be stopped. Another situation can be considered in which removal operation of sheets by an operator is erroneously detected as an output change of the sheet surface sensor due to curl, or vice versa. For example, the fully loaded state might be released although the operator has not removed sheets. Conversely, there is a possibility that the fully loaded state might not be released although the operator has removed sheets.

In view of the above, it is a feature of the present invention to solve at least one of the problems described above and other problems. For example, a feature of the present invention is to reduce erroneous detection of the fully loaded state due to curl imparted to the sheet. The other problems will be understood through the entire specification.

The present invention provides a sheet stacking apparatus comprising a stacking unit, a sheet detection unit, a lower-limit detection unit, a determination unit and a driving unit. The stacking unit accommodates sheets stacked on it. The stacking unit is capable of moving up and down within an operation range from a predetermined upper limit to a predetermined lower limit. The sheet detection unit detects an uppermost sheet of the sheets stacked on the stacking unit. The lower-limit detection unit detects that the stacking unit has reached the lower limit. The determination unit determines that the stacking unit has been fully loaded with sheets if the lower-limit detection unit detects that the stacking unit has reached the lower limit. The driving unit lifts down the stacking unit if the sheet detection unit detects the uppermost sheet of the stacked sheets, and lifts up the stacking unit if the determination unit determines that the stacking unit has been fully loaded with sheets. The determination unit releases a determination of the fully loaded state if elapsed time from the time when the determination unit determines that the stacking unit has been fully loaded with sheets to the time when the sheet detection unit again detects the uppermost sheet of the stacked sheets as a result of the stacking unit being lifted up when the sheet detection unit can no longer detect the sheet after detection of the sheet exceeding a first threshold time preset in correspondence with the amount of curl imparted to the sheet.

According to the present invention, the determination unit determines that the stacking unit has been fully loaded with sheets when the lower-limit detection unit detects that the stacking unit has reached the lower limit. In particular, unlike Japanese Patent Laid-Open No. 2007-153466, the determination of the fully loaded state is not based only on the detection of the uppermost sheet, and therefore erroneous detection of the fully loaded state is considered to decrease. In particular, according to the present invention, the stacking unit is lifted up when the fully loaded state is detected, thereby the sheet detection unit detects the uppermost sheet of the stacked sheets on the stacking unit. Furthermore, if the elapsed time from the time when the sheet is no longer detected to the time when the sheet is again detected exceeds the first threshold time, the determination of the fully loaded state is released. The first threshold time is preset in order to distinguish, for example, between removal of sheets by the operator and decrease in the amount of curl imparted to the sheet. Conversely, if the elapsed time does not exceed the first threshold time, the determination of the fully loaded state is maintained. Consequently, erroneous release of the determination of the fully loaded state due to curl of the sheet is reduced.

Further features of the present invention will become apparent from the following description of exemplary embodiments with reference to the attached drawings.

DESCRIPTION OF THE EMBODIMENTS

Figure 1:
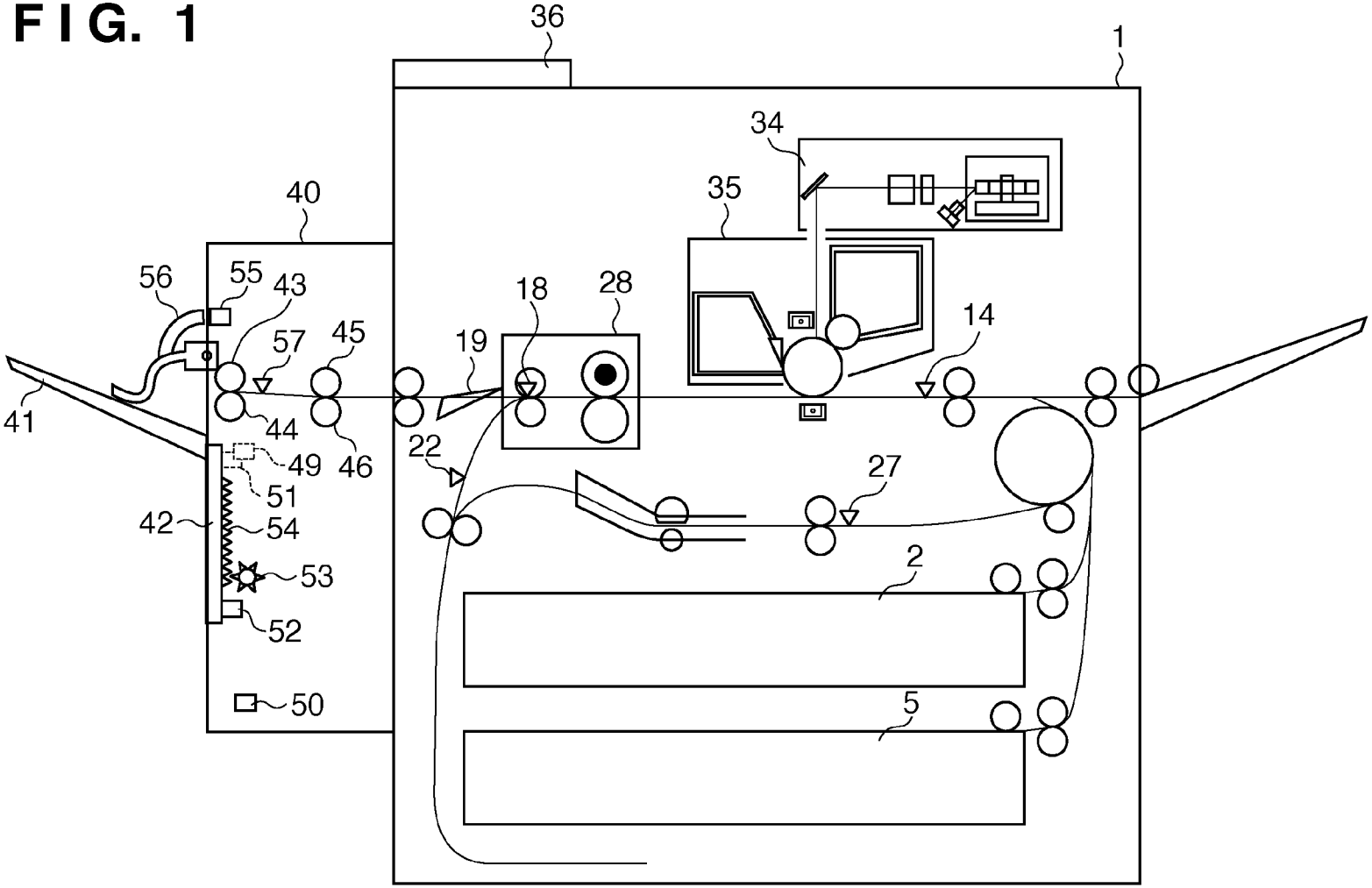
FIG. 1 is a diagram showing an overview of an image forming system.

In FIG. 1, a discharge processing apparatus 40 that is an example of a sheet stacking apparatus according to the present invention is connected to the body of an image forming apparatus 1. In other words, the image forming apparatus 1 and the discharge processing apparatus 40 constitute an image forming system. It should be noted that the sheet stacking apparatus of the present invention is not necessarily for an image forming apparatus. The technical idea of the present invention is applicable to any application as long as the apparatus stacks a plurality of sheet-like members.

The image forming apparatus 1 includes cassettes 2 and 5 that contain sheets. A registration sensor 14 detects the leading edge of a sheet that has been conveyed from either of the cassettes. A sheet on which an image has been formed by an image forming unit that is constituted by a laser unit 34 that illuminates a drum and a toner cartridge 35 that executes developing is conveyed to a fixing unit 28. The fixing unit 28 fixes the toner image on the sheet. A discharge sensor 18 detects that a sheet has been conveyed out of the fixing unit 28. A flapper 19 switches between double-sided image formation and single-sided image formation. Conveying timing sensors 22 and 27 detect timing of conveyance of a sheet in a double-sided conveying unit. An operation panel 36 includes a display apparatus for displaying the operating status of the image forming apparatus 1 and the discharge processing apparatus 40 and an input apparatus for inputting instructions to a control unit.

The discharge processing apparatus 40 is an example of a sheet stacking apparatus. A discharge tray 41 is a tray that holds sheets, and functions as a stacking unit (hereinafter referred to as "elevator stacking unit") capable of moving up and down within a movable range (operation range) from a predetermined upper limit to a predetermined lower limit. A lifter mechanism 42 is a mechanism that moves the discharge tray 41 up and down. In the present embodiment, the lifter mechanism 42 functions as a driving unit that moves the stacking unit downward if a sheet detection unit detects the uppermost (top) sheet of the stacked sheets, and moves the stacking unit upward if a determination unit determines that the stacking unit has been fully loaded with sheets. More specifically, the lifter mechanism 42 functions as a move-down driving unit that moves down the elevator stacking unit if the sheet detection unit detects the uppermost sheet of the stacked sheets, and as a move-up driving unit that moves up the elevator stacking unit if a fully loaded state determination unit determines that the elevator stacking unit has been fully loaded with sheets. Conveyance rollers 43, 44, 45 and 46 convey sheets in the conveying path. An up-limit sensor 49 is a sensor that detects the upper limit of the lifter mechanism that moves the discharge tray 41 up and down. The up-limit sensor 49 outputs a detection signal indicating that the discharge tray 41 has reached the upper limit if the up-limit sensor 49 detects an up-limit flag 51 provided on the movable side of the lifter. The up-limit sensor 49 and the up-limit flag 51 are indicated by dotted lines in FIG. 1 because they may be omitted in the case where a sheet surface sensor 55 also functions as an up-limit sensor 49. The up-limit sensor 49 is an example of an upper-limit detection unit that detects the upper limit of the movable range of the elevator stacking unit. A down-limit sensor 50 is a sensor that detects the lower limit of the lifter mechanism. The down-limit sensor 50 outputs a detection signal indicating that the discharge tray 41 has reached the down limit if the down-limit sensor 50 detects a down-limit flag 52 provided on the movable side of the lifter. The down-limit sensor 50 is an example of a lower-limit detection unit that detects that the elevator stacking unit has reached the lower limit. A lifter motor 53 functions as a driving motor for driving the lifter mechanism 42 and moving the discharge tray 41 up and down. A gear 54 is a part of the lifter mechanism 42, and transmits a driving force from the lifter motor 53 to the lifter mechanism 42. The gear 54 is a mechanism that converts the rotary motion of the lifter motor 53 to a linear motion (vertical motion). The sheet surface sensor 55 detects the position of the upper sheet surface of sheets discharged to and stacked on the discharge tray 41. The sheet surface sensor 55 functions as a sheet detection unit that detects the uppermost sheet of sheets stacked on the elevator stacking unit. A flag 56 is a part of the sheet surface sensor 55, and moves upon contact with a sheet surface. The sheet surface sensor 55 detects a sheet surface by detecting the movement of the flag 56. An out sensor 57 is a sensor for detecting the conveyance state of a sheet in the discharge processing apparatus 40 and verifying that the sheet has been discharged to the discharge tray 41. The lifting time of the lifter mechanism 42 can be defined as the time required for the lifter mechanism 42 to move up from a position at which the down-limit sensor 50 is on to a position at which the up-limit sensor 49 is turned on. The lifting time varies depending on the type of apparatus, but in order to facilitate the description, the lifting time is assumed to be 12 seconds.

The image forming apparatus 1 receives a print instruction from a computer (not shown) or the like. The image forming apparatus 1 picks up a sheet from the cassette 2 or 5, and determines the position of the leading edge of an image formed by the image forming unit based on a result of detection by the registration sensor 14. The image forming apparatus 1 forms an image onto the sheet with the use of the laser unit 34 and the toner cartridge 35. After that, the sheet on which the image has been fixed by the fixing unit 28 passes through the flapper 19 and is discharged to the discharge processing apparatus 40. At this time, the time it takes from the receipt of the print instruction to the discharging of the sheet is called "FPOT" of the image forming apparatus 1. FPOT is an abbreviation for "First Print Out Time", and is the time it takes from the time when an image forming instruction is issued and a sheet is fed until an image is formed onto the sheet and output. Here, it is assumed that the image forming apparatus 1 of the present embodiment has an FPOT of 4 seconds.

The discharge processing apparatus 40 discharges and stacks image-formed sheets discharged from the image forming apparatus 1 onto the discharge tray 41 with the use of the conveyance rollers 43, 44, 45 and 46. The timing when a sheet is stacked on the tray is detected by the out sensor 57, and the height of the sheet surface of the stacked sheets is detected by the sheet surface sensor 55 at the timing when the sheet is stacked.

Figure 2:
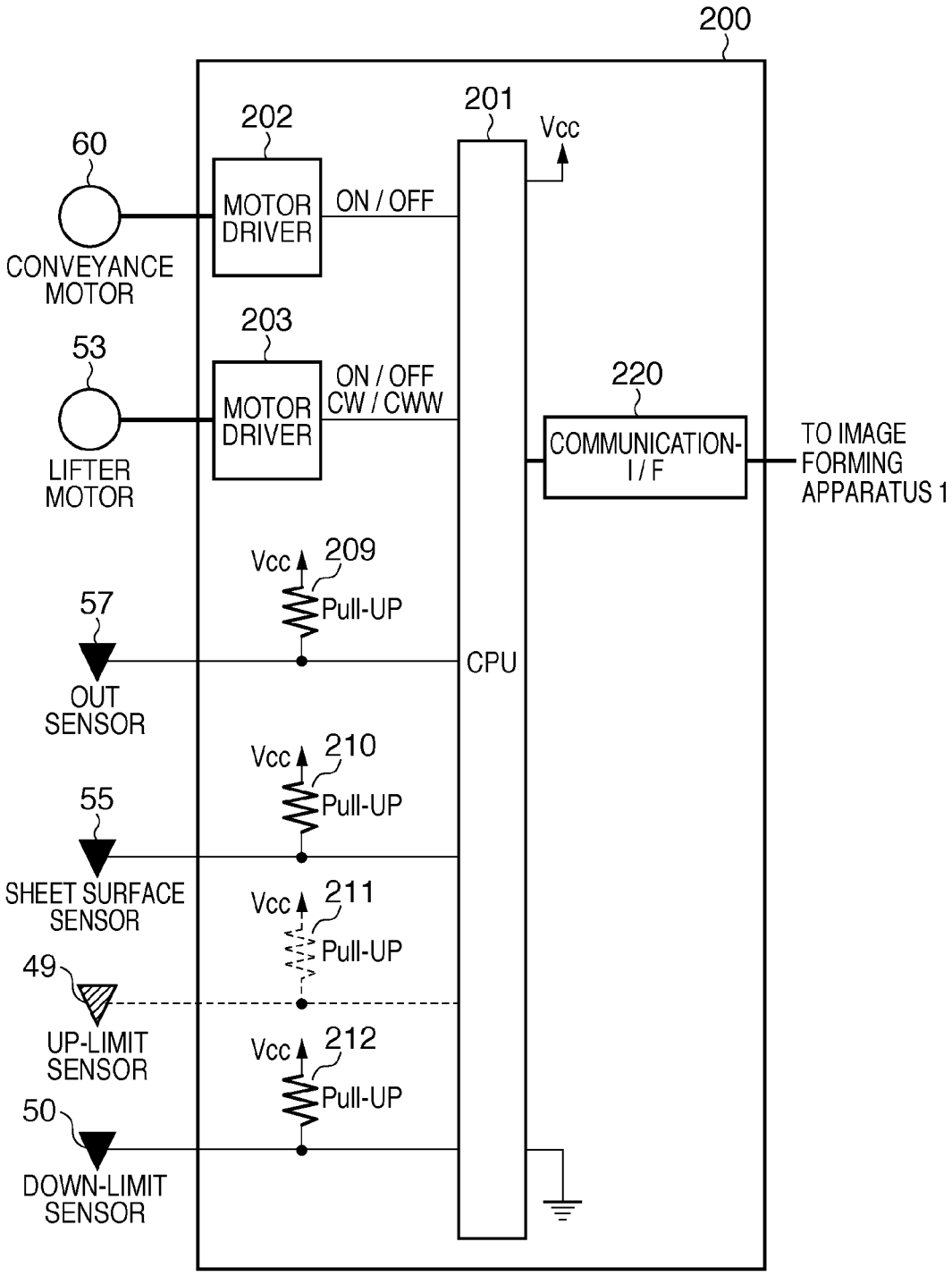
FIG. 2 is a block diagram showing a control unit that controls a discharge processing apparatus.

In FIG. 2, the discharge processing apparatus 40 includes a control substrate 200. A CPU 201 is mounted on the control substrate 200. The CPU 201 performs communication with the image forming apparatus 1 via a communication I/F 220 that is a communication circuit. The CPU 201 receives, for example, a sheet transporting notice from the control unit of the image forming apparatus 1, or transmits a fully loaded state of the tray to the control unit of the image forming apparatus 1.

A motor driver 202 is connected to one of the output terminals provided on the CPU 201. The motor driver 202 is a driving circuit that drives a conveyance motor 60 in accordance with a control signal from the CPU 201. The conveyance rollers 43, 44, 45 and 46 are rotated by rotation of the conveyance motor 60, and thereby a sheet is conveyed. A motor driver 203 is connected to another output terminal of the CPU 201. The motor driver 203 is a driving circuit that drives the lifter motor 53 in accordance with a control signal from the CPU 201. Here, it is assumed that when the lifter motor 53 is rotated clockwise (CW), the lifter mechanism is moved up, moving up the discharge tray 41. Accordingly, when the lifter motor 53 is rotated counterclockwise (CCW), the lifter mechanism is moved down, moving down the discharge tray 41. The up-limit sensor 49 employs a pull-up resistance 211, and inputs a detection signal indicating whether or not the discharge tray 41 is in the upper limit position to the CPU 201. The up-limit sensor 49 may be omitted, as mentioned above. The down-limit sensor 50 employs a pull-up resistance 212, and inputs a detection signal indicating whether or not the discharge tray 41 is in the lower limit position to the CPU 201. The sheet surface sensor 55 employs a pull-up resistance 210, and inputs a detection signal indicating whether or not the uppermost sheet (top sheet) of the sheets stacked on the discharge tray 41 has been detected to the CPU 201. The out sensor 57 employs a pull-up resistance 209, and inputs a detection signal indicating whether a sheet is currently passing therethrough to the CPU 201. In other words, the detection signal indicates that a sheet is currently passing the out sensor 57 during the time from the time when the leading edge of a sheet is detected until the time when passage of the trailing edge is detected. The pull-up resistances mentioned above are used to pull up the signal voltage when each sensor output is in an open state to the Vcc level to stabilize the voltage.

Figure 3:
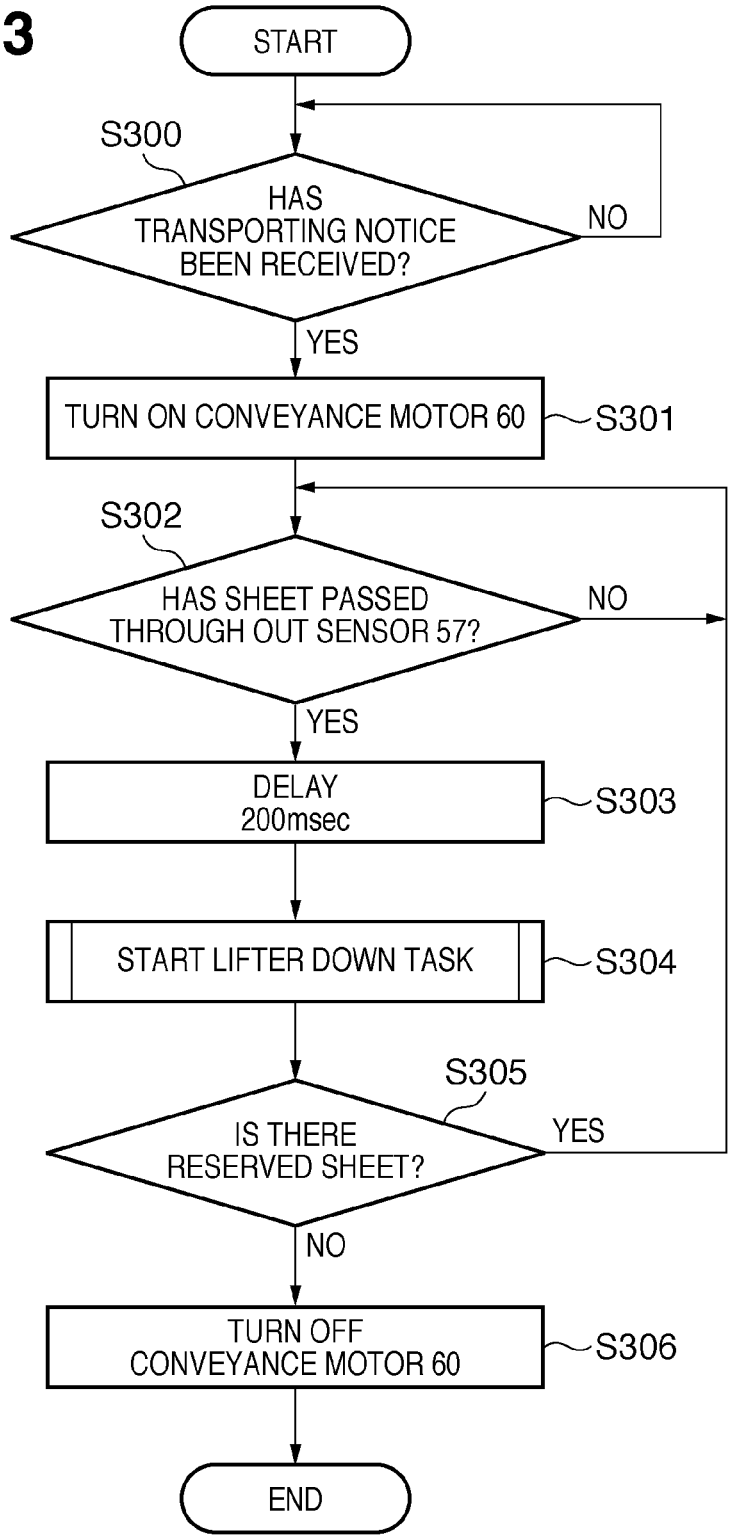
FIG. 3 is a flowchart illustrating a sequence of stacking sheets.

A sequence of stacking sheets on the discharge tray 41 performed by the discharge processing apparatus 40 will be described with reference to FIG. 3. In S300, the CPU 201 determines whether or not a transporting notice signal has been received from the image forming apparatus 1. The procedure advances to the next step if the transporting notice signal is received. In S301, the CPU 201 instructs the motor driver 202 to turn on the conveyance motor 60 as a preparation to transport a sheet. In S302, the CPU 201 determines whether a sheet has passed through the out sensor 57 based on a detection signal from the out sensor 57. If the trailing edge of a sheet passes through the out sensor 57, the procedure advances to the next step. In S303, the CPU 201 waits for a predetermined time. The predetermined time is, for example, 200 msec. This corresponds to the time interval between the time when the trailing edge of a sheet passes through the out sensor 57 and the time to start moving down the lifter mechanism 42, and is determined depending on the length of the conveying path and a stability time of curl imparted to the sheet. Sheets are stacked on the discharge tray 41 for a predetermined time, and the state of the sheet surface sensor 55 is stabilized. When the sheet surface sensor 55 is enabled to receive an input after a predetermined time, the procedure advances to the next step. In S304, the CPU 201 starts a task of moving down the lifter mechanism 42. In S305, the CPU 201 checks whether there is a reserved sheet whose transporting notice signal has been received but that has not yet passed through the out sensor 57. If there is a reserved sheet, the procedure returns to S302. If there is no reserved sheet, the procedure advances to S306. In S306, the CPU 201 instructs the motor driver 202 to stop the conveyance motor 60. The motor driver 202 stops the conveyance motor 60 in response to the stop instruction.

Figure 4:
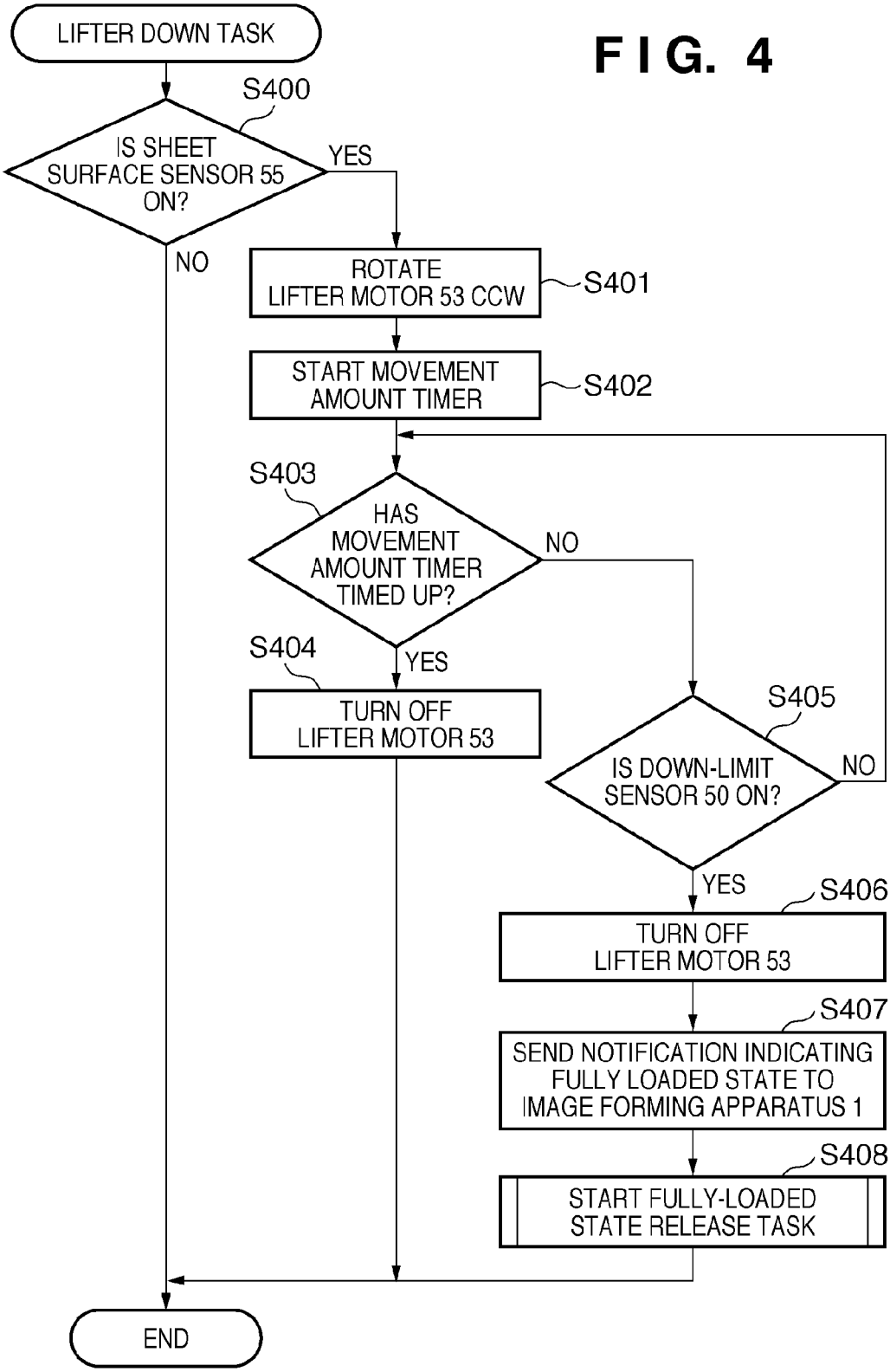
FIG. 4 is a flowchart illustrating a lifter down task.

A sequence of the task of moving down the lifter mechanism 42 (S304) will be described with reference to FIG. 4. In S400, the CPU 201 determines whether or not the sheet surface sensor 55 has detected the sheet. Here, it is assumed that the sheet surface sensor 55 has detected the sheet if the detection signal is on, and the sheet surface sensor 55 has not detected the sheet if the detection signal is off. If the sheet surface sensor 55 is off, it means that the sheet surface is sufficiently low. Accordingly, the lifter down task ends. If, on the other hand, the sheet surface sensor 55 is on, the procedure advances to S401. In S401, the CPU 201 instructs the motor driver 203 to rotate the lifter motor 53 counterclockwise (CCW) in order to move down the lifter mechanism 42. The motor driver 203 rotates the lifter motor 53 counterclockwise (CCW) in response to this instruction. In S402, the CPU 201 starts a movement amount timer for measuring the amount of movement of the lifter mechanism 42 at the time when the operation of the lifter motor 53 is started. The timer can be, for example, a counter or the like. In S403, the CPU 201 determines whether the movement amount timer has timed up. If the movement amount timer has not timed up, the procedure advances to S405. In S405, the CPU 201 determines whether the down-limit sensor 50 has detected that the lifter mechanism 42 has reached the lower limit. If it is determined that the lifter mechanism 42 has reached the lower limit, the CPU 201 determines that the discharge tray 41 is fully loaded with sheets. If, on the other hand, it is determined that the lifter mechanism 42 has not reached the lower limit, the CPU 201 determines that the discharge tray 41 is not fully loaded with sheets. As described above, the CPU 201 functions as a determination unit (fully loaded state determination unit) that determines that the elevator stacking unit has been fully loaded with sheets if the lower-limit detection unit detects that the elevator stacking unit has reached the lower limit. If it is determined that the lifter mechanism 42 has not reached the lower limit, the procedure returns to S403. In case the movement amount timer times up before the down-limit sensor 50 detects that the lifter mechanism 42 has reached the lower limit, the procedure advances to S404. In S404, the CPU 201 instructs the motor driver 203 to stop the lifter motor 53. The motor driver 203 stops the lifter motor 53, and thereby the lifter down task ends. If, on the other hand, the down-limit sensor 50 detects the top sheet before the lifter mechanism 42 reaches the lower limit, the procedure advances to S406. In S406, the CPU 201 stops the lifter motor 53. In S407, the CPU 201 sends a notification indicating that the discharge processing apparatus 40 is in a fully loaded state to the image forming apparatus 1. Upon receiving the notification, the image forming apparatus 1 temporarily stops the image formation processing. In S408, the CPU 201 starts a fully-loaded state release task. Finally, the CPU 201 then ends the lifter down task.

Figure 5:
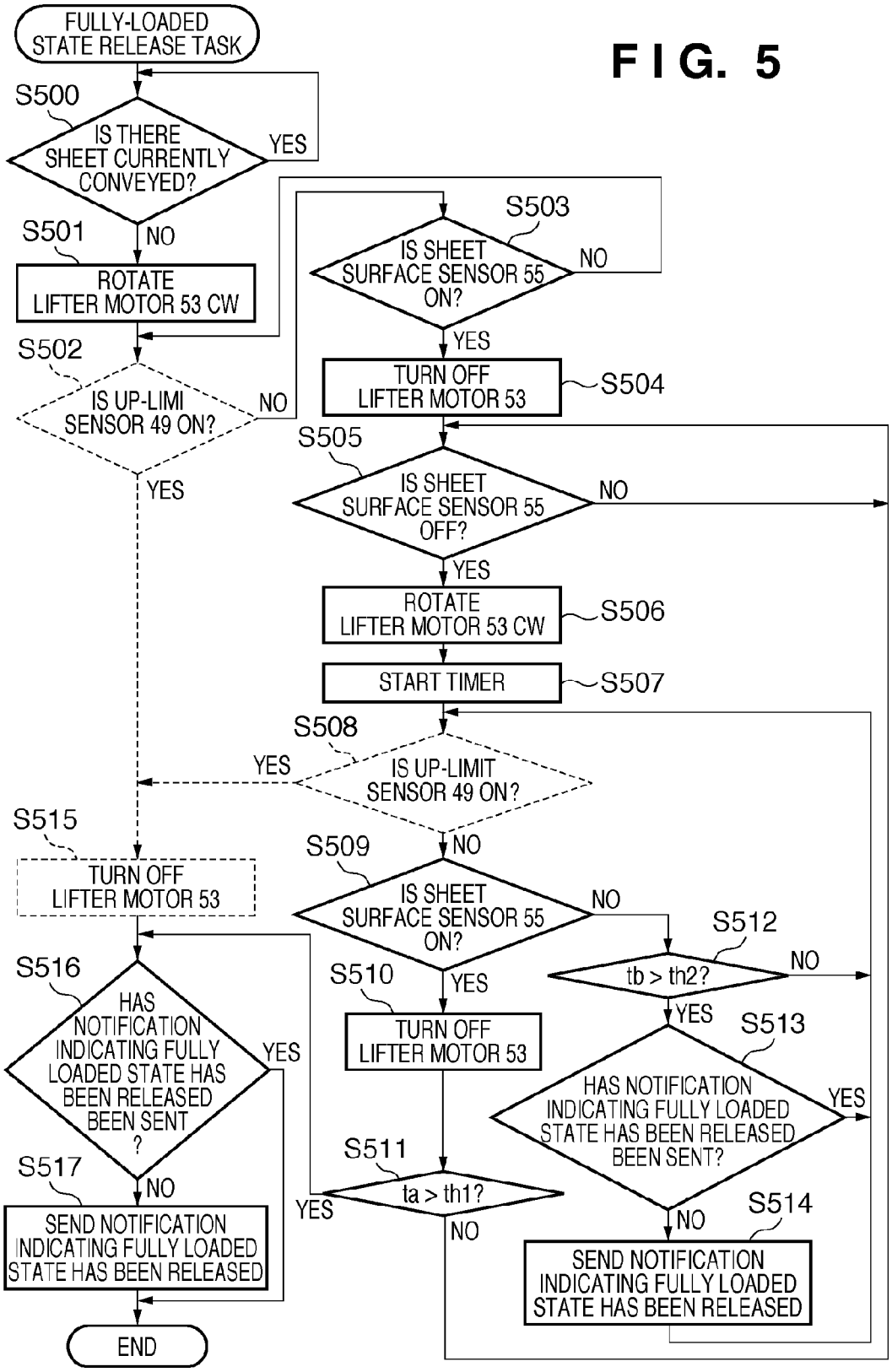
FIG. 5 is a flowchart illustrating a sequence of releasing a fully loaded state.

The fully-loaded state release task (S408) will be described with reference to FIG. 5. In S500, the CPU 201 determines whether there is a sheet that is currently passing through the conveying path based on a detection signal or the like of the out sensor 57. If all sheets have been conveyed, the procedure advances to S501. In S501, the CPU 201 rotates the lifter motor 53 clockwise (CW). The lifter mechanism 42 thereby starts to move up. The CPU 201 checks detection signals from the up-limit sensor 49 and the sheet surface sensor 55 while the lifter mechanism 42 is moving up. In S502, the CPU 201 determines whether the up-limit sensor 49 has been turned on. If it is determined that the up-limit sensor 49 has been turned on, the procedure advances to S515.

In S515, the CPU 201 stops the lifter motor 53. In S516, the CPU 201 determines whether a notification indicating that the fully loaded state has been released has been sent to the image forming apparatus 1. It is assumed that the CPU 201 manages whether the notification indicating that the fully loaded state has been released has been issued by using a flag or the like. If the notification indicating that the fully loaded state has been released has been sent, the CPU 201 ends the fully-loaded state release task. If, on the other hand, the notification indicating that the fully loaded state has been released has not been sent, the procedure advances to S517. In S517, the CPU 201 sends a notification indicating that the fully loaded state has been released to the image forming apparatus 1. After that, the CPU 201 ends the fully-loaded state release task.

If, on the other hand, it is determined in S502 that the up-limit sensor 49 is not on, the procedure advances to S503. In S503, the CPU 201 determines whether the top sheet on the discharge tray 41 has been detected by the sheet surface sensor 55. If it is determined that the top sheet has not been detected, the procedure returns to S502. If, on the other hand, the top sheet is detected by the sheet surface sensor 55 before the lifter mechanism 42 reaches the upper-limit due to the rotation of the lifter motor 53 in S501, the procedure advances to S504. In S504, the CPU 201 stops the lifter motor 53. However, the fully loaded state is not released at this point. In S505, the CPU 201 again waits until the sheet surface sensor is turned off by determining whether the sheet surface sensor has been turned off. During normal operation, the steps S500 to S505 are executed without an operator.

Here, a first threshold time and a second threshold time will be described. In the present invention, when the sheet surface sensor 55 detects the top sheet, the discharge tray 41 is lifted down by a predetermined distance. The top sheet has a large amount of curl immediately after discharge, and the amount of curl decreases over time. For this reason, the sheet surface sensor 55 detects the top sheet that is curled. On the other hand, the CPU 201 determines that the discharge tray 41 has been fully loaded with sheets (S405) when the discharge tray 41 (or in other words, the lifter mechanism 42) reaches the lower limit. Accordingly, the discharge tray 41 is lowered by the amount of curl. When the amount of curl imparted to the top sheet decreases over time, the sheet surface sensor 55 can no longer detect the top sheet. Likewise, if the operator removes all or part of the sheets from the discharge tray 41, there is a possibility that the sheet surface sensor 55 may no longer be able to detect the top sheet. Accordingly, in order to properly release the fully loaded state, it is necessary to understand what makes the sheet surface sensor 55 unable to detect the top sheet. The present invention focuses attention on the time elapsed from the time when the discharge tray 41 starts to move up from the lower limit. That is to say, the CPU 201 defines three phenomena based on the length of the elapsed time. For this reason, the present invention employs a first threshold time and a second threshold time.

The first threshold time is a threshold preset in correspondence with the amount of curl of the sheet in order to distinguish between removal of sheets by the operator and decrease in the amount of curl imparted to the sheet. The discharge tray 41 can move up by an amount equal to the decreased amount of curl of the sheet. Likewise, the discharge tray 41 can move up by an amount equal to the number of sheets removed by the operator. In other words, the elapsed time (lifting time) from the time when the sheet surface sensor 55 can no longer detect the sheet to the time when the sheet surface sensor 55 again detects the sheet as a result of the discharge tray 41 being lifted up is different in these two cases. Here, the first threshold time is assumed to be 2 seconds. If the elapsed time is less than or equal to the first threshold time, the cause of the detection failure is considered to be curl imparted to the sheet, and therefore the determination of the fully loaded state is maintained. If, on the other hand, the elapsed time exceeds the first threshold time, at least part of the sheets are considered to have been removed, and therefore the determination of the fully loaded state is released. The CPU 201 functions as a determination unit that releases the determination of the fully loaded state if the elapsed time from the time when the CPU 201 determines that the stacking unit has been fully loaded with sheets to the time when the sheet detection unit again detects the uppermost sheet of the stacked sheets after the stacking unit is lifted up when the sheet detection unit can no longer detect the sheet after detection of the sheet exceeds a first threshold time preset in correspondence with the amount of curl imparted to the sheet.

The threshold time (2 seconds) is determined corresponding to a maximum value of the amount of curl formed in the sheet. As used herein, the amount of curl is the distance (height) from a flat surface on which a curled sheet is placed to the highest point of the sheet surface. The maximum value of the amount of curl of the sheet is a value empirically determined from sheets for use in image formation by forming an image on a sheet and discharging the sheet in various environments and conditions. If the maximum value of the amount curl is, for example, 3 mm, the threshold time is set to 2 seconds. More specifically, the time obtained by adding a margin to the time required to loosen the height (3 mm) is set to 2 seconds. This value can be changed as appropriate from the empirical results of the amount of curl of the sheet used. There might be a difference in the maximum value of the amount of curl depending on the type of sheet (thin paper, thick paper, calendered paper and the like). In such a case, if the type of sheet is designated in advance, the threshold time (the time corresponding to the maximum value of the amount of curl of each type of sheet) can be switched according to the designated type of sheet, and a determination as to whether to release the fully loaded state can be made. In this manner, it is possible to make a determination as to whether to release the fully loaded state with high accuracy according to the type of sheet, reducing erroneous detection of a fully loaded state and erroneous release of the fully loaded state.

The second threshold time is a value obtained by subtracting the first print out time (e.g., 4 seconds) of the image forming apparatus 1 from the time (e.g., 12 seconds) required for the lifter mechanism 42 to move up from the lower limit to the upper limit. The first threshold time is set shorter than the second threshold time. Here, the second threshold time is set to 8 seconds (12 seconds-4 seconds). If no-detection time during which the top sheet is not continuously detected that is measured when the sheet can no longer be detected exceeds the second threshold time, it is surmised that almost all sheets have been removed from the discharge tray 41, and therefore the determination of the fully loaded state can be released. Because erroneous detection of a fully loaded state and erroneous release of the fully loaded state can be reduced by employing these thresholds, the number of interruptions of image formation can be reduced as compared to conventional technology. The CPU 201 functions as a determination unit that releases the determination of the fully loaded state if the time during which the uppermost sheet of the stacked sheets is not detected by the sheet detection unit once the sheet detection unit has detected the sheet but can no longer detect the sheet exceeding a second threshold time that is longer than the first threshold time.

This will be described in further detail. The cause of the sheet surface sensor 55 being turned off in S505 is an intervention of an operator or a change in the sheet surface sensor 55 due to curl of the sheet. Also, the following three situations can be considered.

First case: a curl of the sheet loosens over time, and thus the sheet surface sensor 55 is turned off.

Second case: an operator has removed only the sheets in his/her print job, and thus the sheet surface is lowered by a certain amount.

Third case: an operator has removed all the sheets stacked on the discharge tray 41 at once.

In the first case, the sheet surface sensor 55 is turned off due to the state of the curl, and therefore the fully loaded state should not be released. Incidentally, in this case, when the CPU 201 detects in S505 that the sheet surface sensor 55 has been turned off due to the curl being loosened, in S506, the CPU 201 rotates the lifter motor 53 clockwise (CW) to lift up the lifter mechanism 42. In S507, the CPU 201 starts the timer for measuring the lifting time. As used herein, the lifting time corresponds to the elapsed time to and the no-detection time tb described above. The timer functions as a first time-measuring unit that measures the time elapsed from the time when the sheet detection unit can no longer detect the uppermost sheet of the stacked sheet after detection of the sheet to the time when the sheet detection unit again detects the sheet as a result of the elevator stacking unit being lifted up. Furthermore, the timer functions as a second time-measuring unit that measures no-detection time during which the uppermost sheet of the stacked sheet is not continuously detected that is measured when the sheet can no longer be detected after detection of the sheet. In S508, the CPU 201 determines whether the up-limit sensor 49 has detected that the discharge tray 41 has reached the upper limit. If it is determined that the discharge tray 41 has reached the upper limit, the procedure advances to S515, where the CPU 201 stops the lifter motor 53. If, on the other hand, it is determined that the discharge tray 41 has not reached the upper limit, the procedure advances to S509. In S509, the CPU 201 determines whether the sheet surface sensor 55 has detected the sheet. Incidentally, even if the curl loosens, there is no significant change in the height of the sheet surface. Accordingly, the sheet surface sensor 55 is again turned on in S509 before the up-limit sensor 49 is turned on in S508. If the sheet surface sensor 55 is not turned on in S509, the procedure advances to S512. In S512, the CPU 201 determines whether the no-detection time tb measured by the timer has exceeded the second threshold time th2. In the case of curl, the lifting time will not exceed the second threshold time th2 (8 seconds). Accordingly, the result of determination made in S512 will not be "YES". If the sheet surface sensor 55 is turned on in S509, the procedure advances to S510. In S510, the CPU 201 stops the lifter motor 53. Because the sheet surface sensor 55 again detects the top sheet, the CPU 201 stops the timer. In S511, the CPU 201 determines whether the elapsed time ta measured by the timer has exceeded the first threshold time th1. In the case of curl, the lifting time will not exceed 2 seconds. In other words, because the elapsed time ta does not exceed the first threshold time th1, the CPU 201 maintains the determination of the fully loaded state, and the procedure returns to S505. As described above, if the cause is curl, the fully loaded state is not released. As described above, because the sheet surface sensor 55 performs sensing with a hysteresis by the above-described sequence, it is possible to control release of the fully loaded state in a stable manner.

The second case will be described next. In the second case, the sheet surface is lowered by a certain amount or more because the operator has removed the sheets. The sheet surface sensor 55 is turned off in S505, in S506, the lifter mechanism starts to move up. In S507, the timer starts measuring time in order to measure elapsed time to and no-detection time tb. After that, the sequence of checking the lifting time using the up-limit sensor 49 and the sheet surface sensor 55 is performed (S508 to S514). In the case where the operator has removed only his/her printed sheets, the lifting time will not exceed 8 seconds, and thus the result of determination made in S512 will not be "YES". If the sheet surface sensor 55 again detects the top sheet in S509, the CPU 201 stops the lifter motor 53 in S510. Furthermore, in the case where the operator has removed only his/her printed sheets, the lifting time exceeds 2 seconds. Accordingly, the result of determination made in S511 will be "YES". Thus, in the second case, in order to release the fully loaded state, the procedure advances to S516. In this manner, the CPU 201 functions as a fully loaded state releasing unit that releases the determination of fully loaded state made by the fully loaded state determination unit if the elapsed time ta exceeds the first threshold time th1. As described above, it is possible to reliably detect sheet removal by an operator, and therefore the fully loaded state can be released and print processing can be restarted without causing stress to the operator.

In the third case, all sheets are removed from the discharge tray 41. Accordingly, the sheet surface sensor 55 is turned off in S505. In S506, the lifter mechanism starts to move up. In S507, the timer starts measuring time in order to measure elapsed time ta and no-detection time tb. After that, the sequence of checking the lifting time using the up-limit sensor 49 and the sheet surface sensor 55 is performed (S508 to S514). Because all sheets have been removed, the lifter mechanism 42 continues to move up until the up-limit sensor 49 is turned on. However, it takes 8 seconds or more before the up-limit sensor 49 is turned on, and thus the result of determination made in S512 will be "YES". Accordingly, the procedure advances to S513, where the CPU 201 determines whether the fully load state has been released. If it is determined that the fully loaded state has been released, the procedure returns to S508. If it is determined that the fully loaded state has not been released, the procedure advances to S514. In S514, the CPU 201 transmits a notification indicating that the fully loaded state has been released. In this manner, the CPU 201 functions as a fully loaded state releasing unit that compares the second threshold time th2 and the no-detection time tb, and releases the determination of fully loaded state made by the fully loaded state determination unit if the no-detection time tb exceeds the second threshold time th2. Upon receiving the notification indicating that the fully loaded state has been released, the image forming apparatus 1 starts printing. The printed sheet is discharged to the discharge processing apparatus 40 after the FPOT has elapsed (after 4 seconds in the case of the present embodiment). In the present embodiment, this discharge timing exactly matches the timing when the lifter mechanism 42 (discharge tray 41) reaches the upper-limit to stop the lifter motor 53. In the third case, the notification indicating that the fully loaded state has been released has been issued, and thus the fully-loaded state release task ends. As described above, the time (4 seconds) during which a sheet is printed and conveyed to the discharge processing apparatus 40 is effectively used, achieving very high efficiency.

According to the present embodiment, the fully loaded state is determined not only based on detection of the uppermost sheet, and therefore, erroneous detection of the fully load state is reduced. Furthermore, if the elapsed time ta from the time when the sheet can no longer be detected to the time when the sheet is detected again exceeds the first threshold time th1, the determination of the fully loaded state is released. The first threshold time th1 is a threshold preset in order to distinguish between removal of sheets by the operator and decrease in the amount of curl imparted to the sheet.

Conversely, if the elapsed time ta does not exceed the first threshold time th1, the determination of the fully loaded state is maintained. Consequently, erroneous release of the determination of the fully loaded state due to curl of the sheet is reduced. In other words, a mere loosening of curl of the sheet does not release the determination of the fully loaded state, and therefore a situation can be prevented in which sheets are erroneously conveyed to the discharge tray 41, causing a paper jam.

Furthermore, in the present embodiment, if the no-detection time tb measured from the time when the sheet can no longer be detected exceeds the second threshold time th2, the determination of the fully loaded state is released. The second threshold time th2 is a value obtained by subtracting the FPOT of the image forming apparatus 1 from the time required to lift up the discharge tray 41 from the lower limit to the upper limit. Accordingly, the timing of discharge of the first sheet after restarting image formation matches the timing when the discharge tray 41 reaches the upper limit to stop the lifter motor 53. In other words, the time during which a sheet on which an image has been formed is conveyed to the discharge processing apparatus 40 is effectively used, achieving very high efficiency.

The sheet surface sensor 55 can also function as an up-limit sensor 49. In this case, the parts indicated by dotted lines in FIGS. 1, 2 and 5 may be omitted. In order to omit the up-limit sensor 49, the discharge tray 41 may be designed such that even if no sheets are stacked on the discharge tray 41 when the discharge tray 41 has reached the upper limit, the discharge tray 41 itself turns on the sheet surface sensor 55. In this manner, even when the sheet surface sensor 55 also functions as an up-limit sensor 49, the same effects as those of the embodiment described above can be obtained.

As described above, the determination unit may release the determination of the fully loaded state if the time during which the uppermost sheet of the stacked sheets is not detected by the sheet detection unit once the sheet detection unit has detected the sheet but can no longer detect the sheet exceeding a second threshold time that is longer than the first threshold time. The second threshold time is a value obtained by subtracting the time during which an image is formed on a sheet by an image forming apparatus and the sheet is discharged to the sheet stacking apparatus from the time required to lift up the stacking unit from the lower limit to the upper limit. If the elapsed time does not exceed the first threshold time, the determination unit may maintain the determination of the fully loaded state. Moreover, the sheet detection unit detects that the stacking unit has reached the upper limit of the operation range of the stacking unit.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-012580, filed on Jan. 22, 2010 which is hereby incorporated by reference herein in its entirety.

What is claimed is:

1. A sheet stacking apparatus comprising:

a stacking unit which accommodates sheets stacked thereon and is capable of moving upward and downward within an operation range between an upper limit and a lower limit;

a sheet detection unit which detects an uppermost sheet of the sheets stacked on the stacking unit;

a lower-limit detection unit that detects that the stacking unit has reached the lower limit;

a determination unit which determines that the stacking unit has been fully loaded with sheets when the lower-limit detection unit detects that the stacking unit has reached the lower limit; and a moving unit which moves the stacking unit upward after the determination unit determines that the stacking unit has been fully loaded with sheets, and stops moving the stacking unit upward when the sheet detection unit detects the uppermost sheet, wherein the moving unit is configured to start moving the stacking unit upward if the sheet detection unit no longer detects the uppermost sheet after the determination unit determines that the stacking unit has been fully loaded with sheets, wherein if an elapsed time from when the stacking unit starts moving upward to when the sheet detection unit detects the uppermost sheet is shorter than or equal to a first threshold time, the determination unit is configured to maintain the determination that the stacking unit has been fully loaded with sheets, and wherein if the elapsed time from when the stacking unit starts moving upward to when the sheet detection unit detects the uppermost sheet is longer than the first threshold time, the determination unit is configured to release the determination that the stacking unit has been fully loaded with sheets.

2. The sheet stacking apparatus according to claim 1, wherein if an elapsed time from a time when the stacking unit starts moving upward is equal to or more than a second threshold time which is longer than the first threshold time, the determination unit is further configured to release the determination that the stacking unit has been fully loaded with sheets.

3. The sheet stacking apparatus according to claim 2, wherein the second threshold time is a value obtained by subtracting the time during which an image is formed on a sheet by an image forming apparatus and the sheet is discharged to the sheet stacking apparatus from the time required to move up the stacking unit from the lower limit to the upper limit.

4. The sheet stacking apparatus according to claim 1, wherein the sheet detection unit detects that the stacking unit has reached the upper limit of the operation range of the stacking unit.

5. An image forming system comprising:

an image forming apparatus which forms an image on a sheet; and a sheet stacking apparatus which stacks sheets discharged from the image forming apparatus, the sheet stacking apparatus comprising:

a stacking unit which accommodates sheets stacked thereon and is capable of moving upward and downward within an operation range between an upper limit and a lower limit;

a sheet detection unit which detects an uppermost sheet of the sheets stacked on the stacking unit;

a lower-limit detection unit that detects that the stacking unit has reached the lower limit;

a determination unit which determines that the stacking unit has been fully loaded with sheets when the lower-limit detection unit detects that the stacking unit has reached the lower limit; and a moving unit which moves the stacking unit upward after the determination unit determines that the stacking unit has been fully loaded with sheets, and stops moving the stacking unit upward when the sheet detection unit detects the uppermost sheet, wherein the moving unit is further configured to start moving the stacking unit upward when the sheet detection unit no longer detects the uppermost sheet after the determination unit determines that the stacking unit has been fully loaded with sheets, wherein if an elapsed time from when the stacking unit starts moving upward to when the sheet detection unit detects the uppermost sheet is shorter than or equal to a first threshold time, the determination unit is further configured to maintain a determination that the stacking unit has been fully loaded with sheets, and wherein if the elapsed time from when the stacking unit starts moving upward to when the sheet detection unit detects the uppermost sheet is longer than the first threshold time, the determination unit is further configured to release the determination that the stacking unit has been fully loaded with sheets.

6. The image forming system according to claim 5, wherein if an elapsed time from a time when the stacking unit starts moving upward is equal to or more than a second threshold time which is longer than the first threshold time, the determination unit is further configured to release the determination that the stacking unit has been fully loaded with sheets.

7. The image forming system according to claim 6, wherein the second threshold time is a value obtained by subtracting the time during which an image is formed on a sheet by an image forming apparatus and the sheet is discharged to the sheet stacking apparatus from the time required to move up the stacking unit from the lower limit to the upper limit.

8. The image forming system according to claim 5, wherein the sheet detection unit detects that the stacking unit has reached the upper limit of the operation range of the stacking unit.

9. The sheet stacking apparatus according to claim 1, wherein after the determination unit determines that the stacking unit has been fully loaded with sheets and the sheet detection unit detects the uppermost sheet, the sheet detection unit no longer detects the uppermost sheet due to loosening of a curl of the uppermost sheet.

10. A method of controlling a sheet stacking apparatus that includes a stacking unit which accommodates sheets stacked thereon and is capable of moving upward and downward within an operation range between an upper limit and a lower limit, a sheet detection unit which detects an uppermost sheet of the sheets stacked on the stacking unit, and a lower-limit detection unit that detects that the stacking unit has reached the lower limit, the method comprising:

determining that the stacking unit has been fully loaded with sheets when the lower-limit detection unit detects that the stacking unit has reached the lower limit; and moving the stacking unit upward after the determining step determines that the stacking unit has been fully loaded with sheets, and stopping the upward movement of the stacking unit when the sheet detection unit detects the uppermost sheet, wherein the moving step starts moving the stacking unit upward if the sheet detection unit no longer detects the uppermost sheet after the determining step determines that the stacking unit has been fully loaded with sheets, wherein if an elapsed time from when the stacking unit starts moving upward to when the sheet detection unit detects the uppermost sheet is shorter than or equal to a first threshold time, the determining step maintains the determination that the stacking unit has been fully loaded with sheets, and wherein if the elapsed time from when the stacking unit starts moving upward to when the sheet detection unit detects the uppermost sheet is longer than the first threshold time, the determining step releases the determination that the stacking unit has been fully loaded with sheets.

11. The method according to claim 10, wherein if an elapsed time from a time when the stacking unit starts moving upward is equal to or more than a second threshold time which is longer than the first threshold time, the determining step releases the determination that the stacking unit has been fully loaded with sheets.

12. The method according to claim 11, wherein the second threshold time is a value obtained by subtracting the time during which an image is formed on a sheet by an image forming apparatus and the sheet is discharged to the sheet stacking apparatus from the time required to move up the stacking unit from the lower limit to the upper limit.

13. The method according to claim 10, wherein after the determining step determines that the stacking unit has been fully loaded with sheets and the sheet detection unit detects the uppermost sheet, the sheet detection unit no longer detects the uppermost sheet due to loosening of a curl of the uppermost sheet.

* * * * *